US006056417A

United States Patent [19]

Cheng

[11] Patent Number: 6,056,417

[45] Date of Patent: May 2, 2000

[54] TWO-PART WEDGE BASE FOR LAMP

[75] Inventor: Yu-Ming Cheng, Hsinchu, Taiwan

[73] Assignee: Eiko, Ltd, Shawnee, Kans.

[21] Appl. No.: 09/208,098

[22] Filed: Nov. 16, 1998

[51] Int. Cl.[7] ..... F21V 19/00

[52] U.S. Cl. ..... 362/226; 362/211; 362/249

[58] Field of Search ..... 362/211, 226, 362/249

[56] References Cited

U.S. PATENT DOCUMENTS

| | | | |
|---|---|---|---|
| 4,603,278 | 7/1986 | Devir et al. | 313/318 |
| 4,752,710 | 6/1988 | Devir et al. | 313/318 |
| 4,979,082 | 12/1990 | Devir | 362/226 |
| 5,278,741 | 1/1994 | Ehrman | 362/226 |
| 5,418,698 | 5/1995 | Wu | 362/226 X |
| 5,669,701 | 9/1997 | Lin | 362/226 |
| 5,785,412 | 7/1998 | Wu et al. | 362/226 |

*Primary Examiner*—Laura K. Tso

*Attorney, Agent, or Firm*—Fay, Sharpe, Fagan, Minnich & McKee, LLP

[57] ABSTRACT

A molded, two-part lamp base receives a press seal of a lamp. Conductor wires from the lamp envelope are folded onto planar regions of the base. A second annular portion of the base is slid along a reduced dimensional region of the first part of the base member to properly position and locate the conductor wires. Once the second portion abuts a shoulder of the first portion, the separate portions of the two part base assembly are fused together to form an integral unit and lock the terminal ends of the conductor wires in place.

7 Claims, 1 Drawing Sheet

TWO-PART WEDGE BASE FOR LAMP

BACKGROUND OF THE INVENTION

This invention pertains to the art of lamps, and more particularly, to lamps having a press seal. The invention is particularly applicable to an automotive or miniature type incandescent lamp and will be described with particular reference thereto. However, it will be appreciated that the invention may be advantageously employed in related lamp environments and applications where it is important to hold the press seal within a base cavity and locate a conductive wire of the lamp at a desired location.

U.S. Pat. Nos. 4,603,278; 4,752,710; and 4,979,082 generally relate to electric lamps of the type disclosed herein where a press seal is formed at one end of a lamp envelope. The press seal is received in a cavity of a molded plastic base member. Lamp leads or conductor wires extend outwardly from the press seal region and through an opening in the base. The leads are typically bent back along an external wall of the base for establishing electrical connection with contacts of an associated fixture.

As will be appreciated, it is important that the conductor wires be accurately located for good electrical connection with the fixture and to prevent adjacent lead wires from contacting one another. For example, in the noted patents, the conductors are embedded within the base member by using a tool to push the conductor wire into a channel. A second tool is then advanced into the channel and causes deformation of the plastic material that forms the base member to assure that the conductor is firmly embedded in place. As described in the patents, the first and second tool members are formed of a metal and thus capable of deforming the softer plastic material that forms the base member.

An alternative assembly and process of manufacturing the arrangement is desired, accommodating dissimilar materials, to provide a reliable, easily manufactured lamp base. At the same time, it is desired that any proposed assembly accurately and dependably secure adjacent conductor wires in a desired location.

SUMMARY OF THE INVENTION

The present invention contemplates a new and improved base of the type that receives a press seal of a lamp that overcomes noted problems relative to securing the conductors in an economic, reliable manner.

According to the invention the base is a two-part assembly. The first part includes a first, enlarged dimension region that has a cavity adapted to receive the press seal of the lamp. The lead wires or conductors extend outwardly from openings formed in a second, reduced dimension portion of the first base part and are adapted to be wrapped around an external surface of the second reduced dimension region of the first part of the base. Thereafter, a second part of the base assembly, preferably defined by an annular sleeve, is slid over the reduced dimension region and the conductor wires.

According to another aspect of the invention, an internal opening of the annular member includes grooves at desired locations to align the conductors as the annular member is slid onto the first portion of the base.

According to yet another aspect of the invention, the annular member is secured to the base member, thereby locking the conductor wires in the desired location.

A principal advantage of the invention is found in the simple manner of accurately aligning the conductor wires of the lamp and securing them for connection with a lamp fixture.

Yet another advantage of the invention resides in the ease with which the base components may be manufactured and assembled.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification. The embodiment is illustrated in the accompanying drawings which form a part of the invention and wherein.

DETAILED DESCRIPTION OF THE PREFERRED EMBODIMENT

Figure 1:
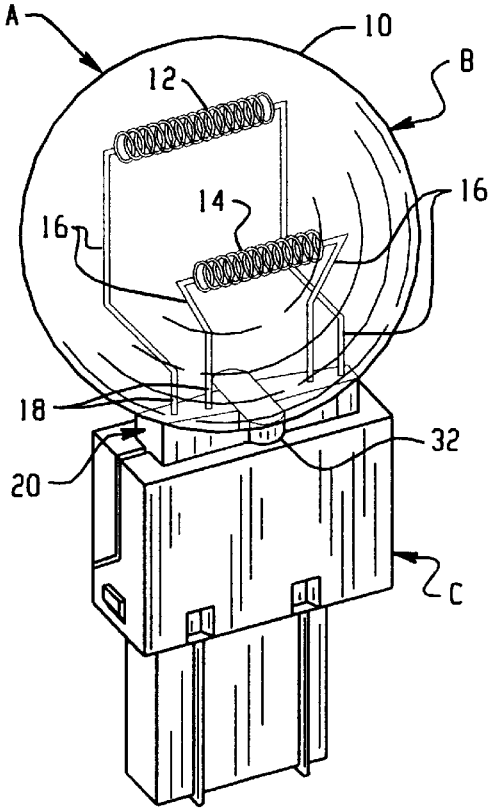
Fig. 1 (PRIOR ART)
FIG. 1 is an isometric view of a prior art lamp and base assembly.

Referring now to the drawings wherein the showings illustrate the preferred embodiment of the invention only and are not intended to limit the invention, the Figures show a lamp assembly A that includes a lamp B received in a molded base member C. More particularly, and with reference to the prior art of FIG. 1, a generally spherical envelope 10 encloses first and second filaments 12, 14. It will be understood that the invention is not limited to a dual filament arrangement and that this embodiment is merely illustrative of one preferred arrangement. The filaments or coils are supported in the envelope by lead wires or conductor wires 16. The lead wires support opposite ends of the coils and also carry the required electrical current thereto so that the coils serve as a light source of the lamp in a manner well known in the art. Opposite or lower ends 18 of the lead wires proceed outwardly from the envelope 10.

The lead wires are hermetically sealed to the envelope in a press seal region 20 of the envelope. As is conventional in the art, the envelope is softened at its lower end in the press seal region, and a mechanical deforming or pressing operation is completed on the base of the envelope. This provides a hermetic seal around the lead wires as they exit the envelope so that desired seal integrity is achieved with the incandescent lamp.

Figure 2:
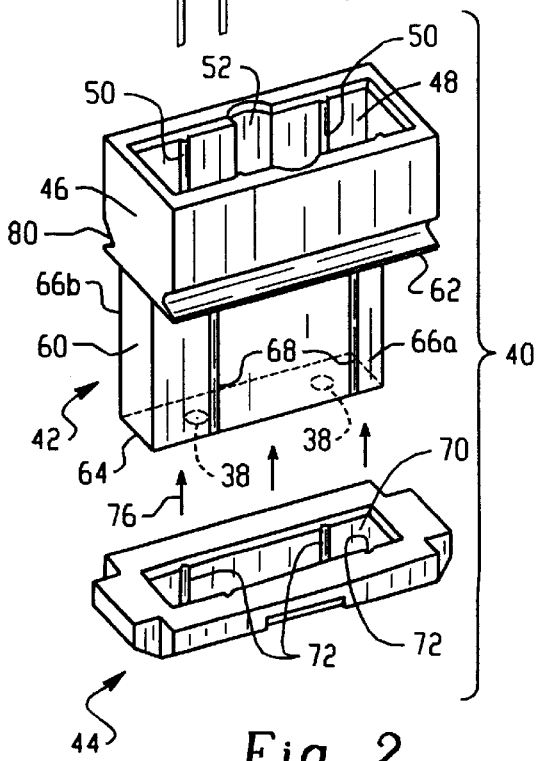
FIG. 2 is an exploded view of a lamp and two-part base assembly formed in accordance with the present invention.

A central portion of the press seal region encloses an exhaust tube 30 (FIG. 2). The exhaust tube is typically of a diameter slightly larger than the thickness of the press seal region so that it defines semi-circular portions 32 along opposite sides of the press seal region. The semi-circular portions 32 generally extend along the entire height of the press seal. The exhaust tube is used to establish a proper atmosphere in the lamp envelope. The exhaust tube is later tipped off or sealed to maintain the desired environment therein.

The elongated lead or conductor wires pass through openings 38 in the bottom of a base member 40. As shown, the base member is actually an assembly of two parts, a first portion 42 and a second portion 44. The first portion 42 has a first enlarged dimension region 46 having a cavity 48. In the preferred arrangement, the first region and the cavity both have a substantially rectangular cross-sectional configuration and the cavity is dimensioned to receive the press seal portion of the lamp envelope therein. Ribs 50 extend into the cavity at spaced locations for securing the press seal in place, for example, by means of a friction fit. As shown, the ribs extend from facing parallel walls that define the cavity, although it will be understood that the ribs may be positioned at still other locations, for example from the semicircular recesses 52, for forming a friction fit with the press seal region of the lamp.

The lead wires are of extended length and extend outwardly through the wall (not shown) defining the bottom wall of the cavity 48. The lead wires also proceed through a reduced dimension or second region 60 of the first part of the base assembly that extends outwardly from the first enlarged dimension region. The different dimensions of the first and second regions define a shoulder 62 at the interface of these regions. The conductor wires extend outwardly from an opening(s) in bottom surface 64 of the second region and are then wrapped or turned upwardly along opposite parallel, planar surfaces 66*a* and 66*b*. This positions or locates the wire conductors along the external surface (shown by shaded regions 68) on the planar face 66*a* and likewise on planar face 68*b* where electrical contact may be established with an associated fixture.

It is important that the conductors be properly positioned along the respective planar surfaces 66*a*, 66*b* and maintained in position. According to the present invention, this is achieved through use of the second part 44 of the two part base. The second part is an annular member having a central opening 70 that is substantially rectangular in cross-section. The opening 70 includes a series of grooves 72 disposed along the internal surface that are dimensioned and adapted to be received over the conductor wires as they lie flush along the planar faces 66*a*, 66*b*. The grooves are disposed at predetermined locations so that the conductor wires are aligned from the lower surface 64.

Moreover, the annular member 44 has a height so that terminal ends of the conductor wires are maintained within the annular member once it has been fully assembled to the first part 46. As illustrated by arrows 76, the second part or annular member 44 is longitudinally advanced over the reduced dimension portion 60 of the first part 46 of the base assembly. It is advanced upwardly until it engages the shoulder 62. At that point, terminal ends of the conductor wires are disposed in the grooves 72 and pressed against the respective planar surfaces 66*a*, 66*b*.

Figure 3:
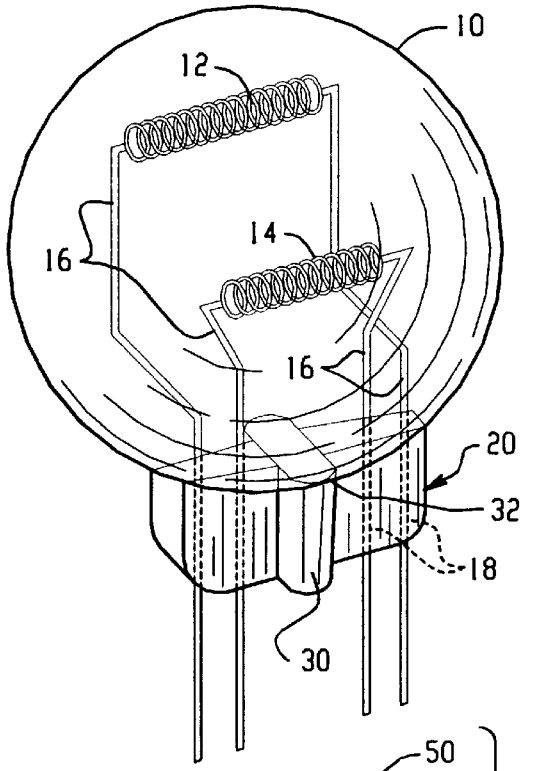
FIG. 3 is a perspective view of the assembled components of the base of FIG. 2 to form an integral base member.
Figure 3:
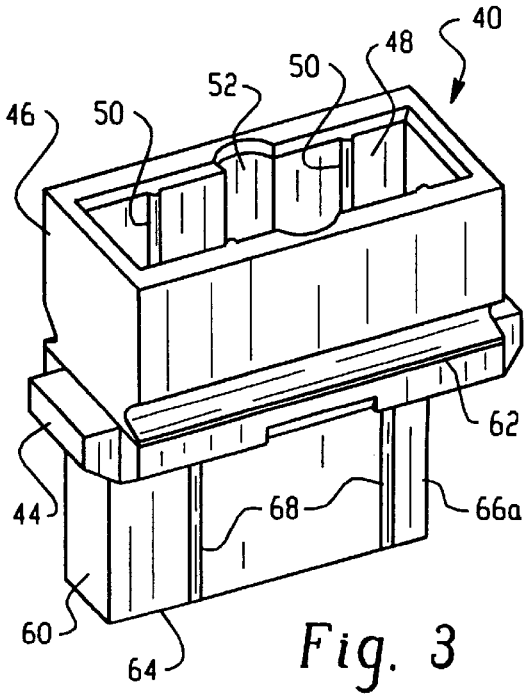

The second, annular member portion 44 is then secured to the first part, such as through an ultrasonic wave fusing operation, i.e., sonically welded together, so that the first and second portions of the base member become an integral unit (FIG. 3).

This assembly allows the conductor wires to have a dimensional tolerance as measured by the thickness of the second portion of the base. As long as terminal ends of the conductor wires reach a distance sufficient to be received in the internal opening 70, they will be securely held in place when the first and second portions of the base assembly are secured together.

The invention has been described with reference to the preferred embodiment. Obviously, modifications and alterations will occur to others upon a reading and understanding of this specification. For example, it is recognized that the location of the shoulder 64 of the first member 42 against which the annular member 44 abuts may be at different heights to accommodate the enlarged press seal region of the envelope. Thus, the shoulder is shown as a large cross-sectional dimension area, although recess or groove 80 (FIG. 2) formed in the periphery could define the shoulder of the first region 46. It is intended to include all such modifications and alterations insofar as they come within the scope of the appended claims or the equivalents thereof.

Having thus described the invention, it is claimed:

1. A base assembly for an incandescent lamp that has a press seal region that encloses lead wires extending from the press seal region, the base assembly comprising:

a first portion having a cavity dimensioned to closely receive the incandescent lamp therein and including an opening in a base thereof through which the lead wires can extend from the first portion; and an annular second portion including a central opening therethrough for close sliding receipt over a region of the first portion, the opening having grooves for aligning the lead wires between the first and second portions and entrapping the lead wires between the first and second portions.

2. The base assembly of claim 1 wherein the first and second portions are secured together.

3. The base assembly of claim 1 wherein the first and second portions are fusion bonded together.

4. The base assembly of claim 1 wherein the first portion includes a shoulder that abuttingly engages the second portion.

5. The base assembly of claim 4 wherein the first and second portions are fusion bonded together along the shoulder.

6. The base assembly of claim 4 wherein the shoulder is continuous about a periphery of the first portion.

7. The base assembly of claim 1 wherein the first portion includes an enlarged dimension first region and a second region having a reduced cross-section relative to the first region, and the central opening formed in the second portion dimensioned for close receipt about the second region of the first portion.

* * * * *